US011181131B2

(12) United States Patent
Fukuda

(10) Patent No.: US 11,181,131 B2
(45) Date of Patent: Nov. 23, 2021

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/567,548

(22) Filed: Sep. 11, 2019

(65) Prior Publication Data

US 2020/0087890 A1 Mar. 19, 2020

(30) Foreign Application Priority Data

Sep. 13, 2018 (JP) ..... JP2018-171758

(51) Int. Cl.
*F15B 11/042* (2006.01)
*F15B 21/0423* (2019.01)

(52) U.S. Cl.
CPC ..... *F15B 21/0423* (2019.01); *F15B 11/0426* (2013.01)

(58) Field of Classification Search
CPC ..... F15B 2211/62; F15B 2211/31582; F15B 11/04263; F15B 21/0423; F15B 11/0426
See application file for complete search history.

(56) References Cited

U.S. PATENT DOCUMENTS 9,828,745 B2 * 11/2017 Ueda ..... E02F 9/226
2016/0305093 A1 * 10/2016 Fukuda ..... E02F 9/2232
2016/0333551 A1 * 11/2016 Joung ..... E02F 9/2228

FOREIGN PATENT DOCUMENTS

JP 2010078038 A 4/2010

* cited by examiner

*Primary Examiner* — F Daniel Lopez
(74) *Attorney, Agent, or Firm* — Greenblum & Bernstein, P.L.C.

(57) ABSTRACT

A hydraulic system includes a first system discharge fluid tube that discharges fluid flowing through a first supply fluid tube, a second system discharge fluid tube that discharges fluid, a first control valve, and a second control valve connected to a second supply fluid tube, the first system discharge fluid tube, and the second system discharge fluid tube, configured to be switched between: a supply position that supplies fluid from the second supply fluid tube to the first supply fluid tube; a first stop position that stops supply of fluid from the second to the first supply fluid tube and supplies fluid from the first supply fluid tube to the first system discharge fluid tube; and a second stop position that stops supply of fluid from the second to the first supply fluid tube and supplies fluid from the first supply fluid tube to the second system discharge fluid tube.

7 Claims, 3 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. P2018-171758, filed Sep. 13, 2018. The content of this application is incorporated herein by reference in their entirety.

BACKGROUND OF THE INVENTION

Field of the Invention

The present invention relates to a hydraulic system for a working machine and to a control valve.

Description of Related Art

A technique disclosed in Japanese Unexamined Patent application publication No. 2010-78038 is known as a hydraulic system for a working machine. The working machine disclosed in Japanese Unexamined Patent application publication No. 2010-78038 includes a boom, a bucket, a boom cylinder configured to move the boom, a bucket cylinder configured to move the bucket, an auxiliary actuator configured to operate the auxiliary attachment, a first control valve configured to control the stretching and shortening of the boom cylinder, a second control valve configured to control the stretching and shortening of the bucket cylinder, and a third control valve configured to operate the auxiliary actuator.

SUMMARY OF THE INVENTION

A hydraulic system for a working machine, includes: a first hydraulic pump constituted of a fixed displacement pump; a second hydraulic pump constituted of a fixed displacement pump; a hydraulic actuator; a first supply fluid tube connecting the first hydraulic pump and the hydraulic actuator; a second supply fluid tube connecting the second hydraulic pump and the first supply fluid tube; a first system discharge fluid tube to discharge operation fluid that has flowed through the first supply fluid tube; a second system discharge fluid tube to discharge the operation fluid separately from the first system discharge fluid tube, the second system discharge fluid tube being connected to the first system discharge fluid tube; a pressure increasing portion to rise a pressure of the operation fluid, the pressure increasing portion being arranged in the first system discharge fluid tube; a first control valve to control a flow rate of the operation fluid of the first supply fluid tube, the first control valve being arranged in the first supply fluid tube; and a second control valve connected to the second supply fluid tube, the first system discharge fluid tube, and the second system discharge fluid tube, configured to be switched between: a supply position allowing the operation fluid of the second supply fluid tube to be supplied to the first supply fluid tube; a first stop position stopping supplying the operation fluid of the second supply fluid tube to the first supply fluid tube and allowing the operation fluid of the first supply fluid tube to be discharged to the first system discharge fluid tube; and a second stop position stopping supplying the operation fluid of the second supply fluid tube to the first supply fluid tube and allowing the operation fluid of the first supply fluid tube to be discharged to the second system discharge fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
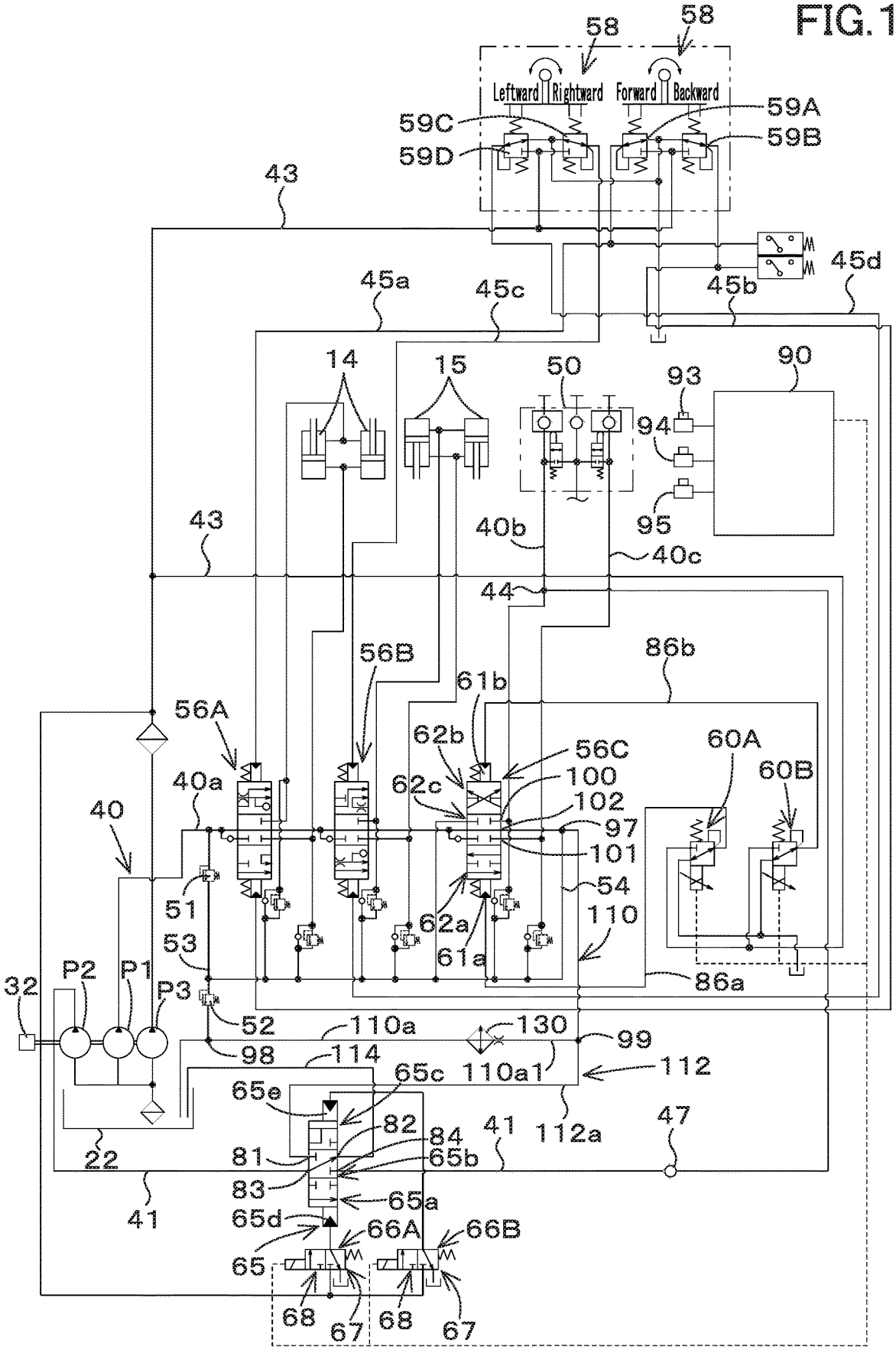
FIG. 1 is a schematic view of a hydraulic system for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings.

Figure 3:
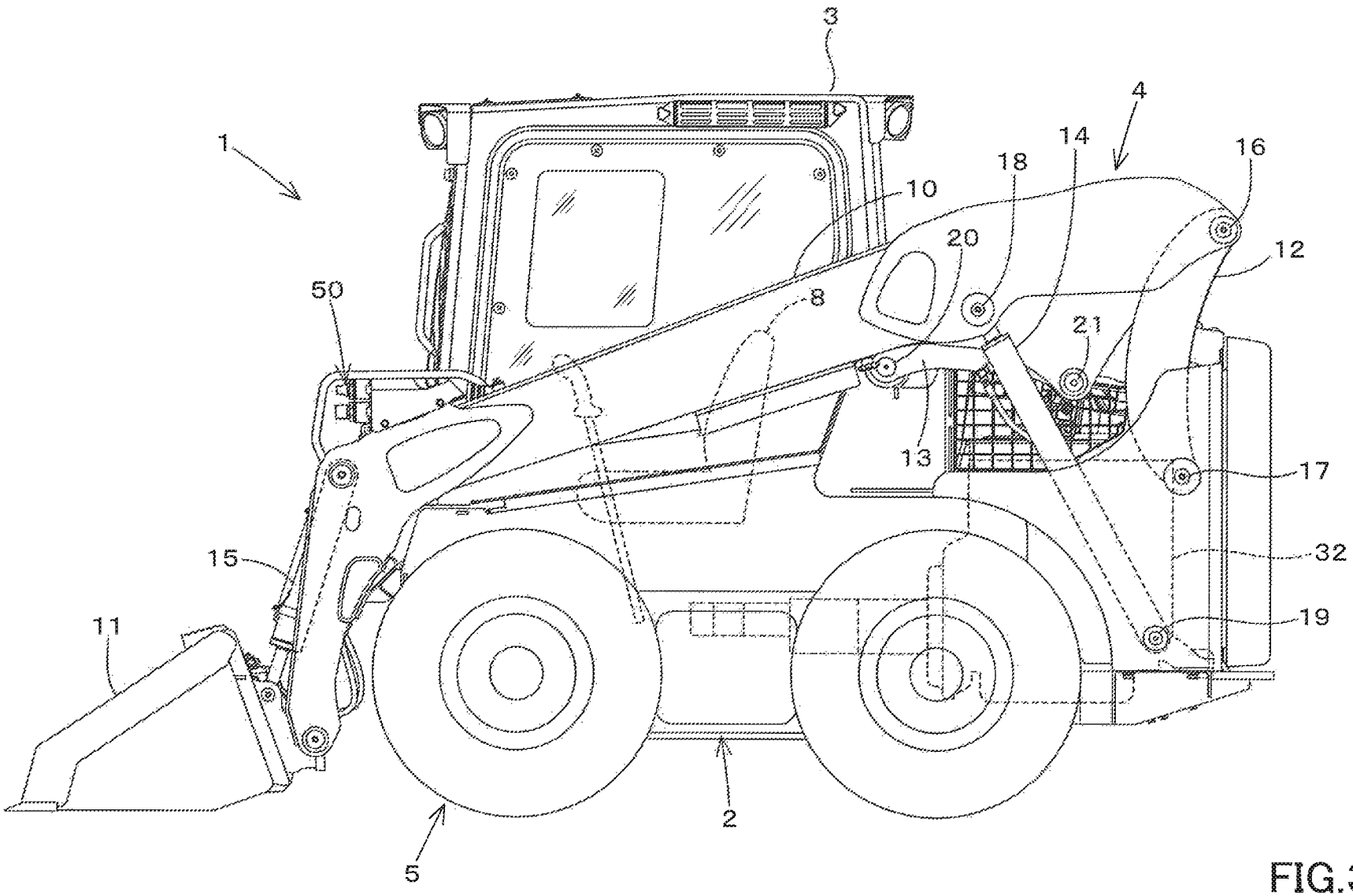
FIG. 3 is a side view of a skid steer loader exemplified as the working machine according to the embodiment.

FIG. 3 shows a side view of a working machine according to the embodiment of the present invention. In FIG. 3, a skid steer loader is shown as an example of the work machine. However, the working machine according to the embodiment of the present invention is not limited to the skid steer loader, and may be another type of loader working machine such as a compact truck loader. Moreover, a working machine other than the loader working machine may be employed.

As shown in FIG. 3, the working machine 1 includes a machine body 2, a cabin 3, a working device 4, and a traveling device 5. In the embodiment of the present invention, the front side (the left side in FIG. 3) of the operator seated on an operator seat 8 of the working machine 1 will be described as the front, the rear side (the right side in FIG. 3) of the operator will be described as the rear, the left side of the operator will be described as the left, and the right side of the operator will be described as the right.

In addition, the horizontal direction, which is a direction orthogonal to the front-rear direction, will be described as the machine width direction. The direction extending from the center portion of the machine body 2 toward the right portion or the left portion will be described as the machine outward direction. In other words, the machine outward direction is the machine width direction and a direction separating away from the machine body 2.

The direction opposite to the machine outward direction will be described as the machine inward direction. In other words, the machine inward direction is the machine width direction and a direction approaching the machine body 2.

The cabin 3 is mounted on the machine body 2. The cabin 3 is provided with the operator seat 8. The working device 4 is attached to the machine body 2. The traveling device 5 is provided outside the machine body 2.

A prime mover 32 is mounted internally at the rear portion of the machine body 2. The prime mover 32 is constituted of an electric motor, an engine, and the like. In this embodiment, the prime mover 32 is constituted of the engine.

The working device 4 includes a boom 10, a working tool 11, a lift link 12, a control link 13, a boom cylinder 14, and a bucket cylinder 15.

The boom 10 is arranged on the right side of the cabin 3, and capable of being swung upward and downward. Another boom 10 is arranged on the left side of the cabin 3, and capable of being swung upward and downward. The working tool 11 is, for example, a bucket, and the bucket 11 is arranged at the tip end portion (the front end portion) of the boom 10, and capable of being swung upward and downward.

The lift link 12 and the control link 13 support the base portion (rear portion) of the boom 10 such that the boom 10 can be swung upward and downward.

The boom cylinder 14 is stretched and shortened to lift and lower the boom 10. The bucket cylinder 15 is stretched and shortened to swing the bucket 11.

The front portion of the boom 10 arranged on the right side is coupled to the front portion of the boom 10 arranged on the left by a deformed connection pipe. The base portions (rear portions) of the booms 10 are coupled to each other by a circular connection pipe.

A pair of the lift link 12, the control link 13, and the boom cylinder 14 is provided on the left side of the machine body 2 corresponding to the boom 10 arranged on the left side. Another pair of the lift link 12, the control link 13, and the boom cylinder 14 is provided on the right side of the machine body 2 corresponding to the boom 10 arranged on the right side.

The lift link 12 is arranged in the longitudinal direction on the rear portion of the base portion of each of the booms 10. The upper portion (one end side) of the lift link 12 is pivotally supported around the lateral axis via a pivot shaft 16 (a first pivot shaft) near the rear portion of the base portion of each of the booms 10.

In addition, the lower portion (the other end side) of the lift link 12 is pivotally supported around the lateral axis via a pivot shaft 17 (a second pivot shaft) near the rear portion of the machine body 2. The second pivot shaft 17 is arranged below the first pivot shaft 16.

The upper portion of the boom cylinder 14 is pivotally supported about the lateral axis via a pivot shaft 18 (a third pivot shaft). The third pivot shaft 18 is arranged on a base portion of each of the booms 10, that is, on the front portion of the base portion.

The lower portion of the boom cylinder 14 is pivotally supported around the lateral axis via a pivot shaft 19 (a fourth pivot shaft). The fourth pivot shaft 19 is provided near the lower portion of the rear portion of the machine body 2 and below the third pivot shaft 18.

The control link 13 is provided in front of the lift link 12. One end of the control link 13 is pivotally supported about the lateral axis via a pivot shaft 20 (a fifth pivot shaft). The fifth pivot shaft 20 is arranged on the machine body 2, that is, on a position corresponding to the front of the lift link 12.

The other end of the control link 13 is pivotally supported about the lateral axis via a pivot shaft 21 (a sixth pivot shaft). The sixth pivot shaft 21 is arranged on the boom 10, that is, in front of the second pivot shaft 17 and above the second pivot shaft 17.

When the boom cylinder 14 is stretched and shortened, each of the booms 10 swings up and down around the first pivot shaft 16 while the base portion of each boom 10 is supported by the lift link 12 and the control link 13, and thus the tip end portion of each of the booms 10 is lifted and lowered.

The control link 13 swings up and down around the fifth pivot shaft 20 in synchronization with the upward and downward swinging of each of the booms 10. The lift link 12 swings back and forth around the second pivot shaft 17 in synchronization with the upward and downward swinging of the control link 13.

Another working tool can be attached to the front portion of the boom 10 instead of the bucket 11. Another working tool is an attachment (auxiliary attachment) such as a hydraulic crusher, a hydraulic breaker, an angle broom, an earth auger, a pallet fork, a sweeper, a mower, and a snow blower.

A connecting member 50 is arranged at the front portion of the boom 10 arranged on the left. The connecting member 50 is a member to which a piping member such as a pipe connected to the auxiliary actuator included in the auxiliary attachment is connected.

The bucket cylinder 15 is arranged near the front portion of each of the booms 10. When the bucket cylinder 15 is stretched and shortened, the bucket 11 is swung.

In the present embodiment, the traveling device 5 arranged on the left side is a wheel-type traveling device 5A having front wheels 5F and rear wheels 5R, and another traveling device 5 arranged on the right side is a wheel-type traveling device 5B having front wheels 5F and rear wheels 5R. Note that crawler type traveling devices 5A and 5B (including semi-crawler type traveling devices 5A and 5B) may be employed as the traveling devices 5A and 5B.

As shown in FIG. 1, the hydraulic system for the working machine includes a first hydraulic pump P1, a second hydraulic pump P2, and a third hydraulic pump P3.

The first hydraulic pump P1, the second hydraulic pump P2, and the third hydraulic pump P3 are pumps configured to be driven by the power of the prime mover 32, and are constituted of the fixed displacement gear pumps (the constant displacement gear pumps).

The first hydraulic pump P1 is capable of outputting the operation fluid stored in the operation fluid tank 22. The first hydraulic pump P1 mainly outputs the operation fluid for operating the hydraulic actuator. A first supply fluid tube 40 is provided at an output port (an outlet port) for outputting the operation fluid in the first hydraulic pump P1.

The second hydraulic pump P2 is also a pump capable of outputting the operation fluid stored in the operation fluid tank 22 and increasing the operation fluid supplied to the hydraulic actuator. A second supply fluid tube 41 is provided at an output port (an outlet port) for outputting the operation fluid in the second hydraulic pump P2.

The third hydraulic pump P3 is also capable of outputting the operation fluid stored in the operation fluid tank 22. An fluid tube 43 is provided at an output port (an outlet port) for outputting the operation fluid in the third pump. In particular, the third hydraulic pump P3 outputs the operation fluid mainly used for the controlling.

For convenience of the explanation, the operation fluid outputted from the third hydraulic pump P3 is referred to as a pilot fluid, and a pressure of the pilot fluid is referred to as a pilot pressure.

The first supply fluid tube 40 includes a boom control valve 56A, a bucket control valve (a working tool control valve) 56B, and an auxiliary control valve 56C. The boom control valve 56A is a valve configured to control a hydraulic cylinder (a boom cylinder) 14 for controlling the boom. The bucket control valve 56B is a valve configured to control a hydraulic cylinder (a bucket cylinder) 15 for controlling the bucket.

The auxiliary control valve 56C is a valve for controlling an auxiliary actuator (a hydraulic cylinder, a hydraulic motor) attached to an auxiliary attachment such as a hydraulic crusher, a hydraulic breaker, an angle broom, an earth auger, a pallet fork, a sweeper, a mower, and a snow blower.

Each of the boom control valve 56A and the bucket control valve 56B is a direct acting spool three-position switching valve of pilot-operating type. The boom control valve 56A and the bucket control valve 56B are switched, by the pilot pressure, between a neutral position, a first position other than the neutral position, and a second position other than the neutral position and the first position.

The boom cylinder 14 is connected to the boom control valve 56A by a fluid tube, and the bucket cylinder 15 is connected to the bucket control valve 56B by a fluid tube.

The boom 10 and the bucket 11 can be operated by an operation lever 58 provided around the operator seat 8. The operation lever 58 is supported so as to be tilted, from the neutral position, in the front-rear direction, in the left-right direction, and in the diagonal directions.

When the operation lever 58 is tilted, a plurality of pilot valves (operation valves) 59A, 59B, 59C, and 59D arranged on a lower portion of the operation lever 58 are operated. The pilot valves 59A, 59B, 59C, and 59D and the third hydraulic pump P3 are connected by the fluid tube 43.

The plurality of pilot valves (operation valves) 59A, 59B, 59C, and 59D are connected to the boom control valve 56A and the bucket control valve (working tool control valve) 56B each other by a plurality of fluid tubes 45*a*, 45*b*, 45*c*, and 45*d*.

In particular, the pilot valve 59A is connected to the boom control valve 56A by the fluid tube 45*a*. The pilot valve 59B is connected to the boom control valve 56A by the fluid tube 45*b*. The pilot valve 59C is connected to the bucket control valve 56B by the fluid tube 45*c*. The pilot valve 59D is connected to the bucket control valve 56B by the fluid tube 45*d*.

The pilot valves (operating valve) 59A, 59B, 59C, and 59D respectively can set the pressure of operation fluid to be outputted in accordance with the operation of the operating lever 58.

In particular, when the operation lever 58 is tilted forward, the pilot valve (operating valve) 59A for the lowering operation is operated, and then the pilot pressure of the pilot fluid to be outputted from the pilot valve 59A for the lowering operation is set. The pilot pressure is applied to a pressure receiving portion of the boom control valve 56A, then the boom cylinder 14 is shortened, and then the boom 10 is lowered.

When the operation lever 58 is tilted backward, the pilot valve (operating valve) 59B for the lifting operation is operated, and then the pilot pressure of the pilot fluid to be outputted from the pilot valve 59B for the lifting operation is set.

The pilot pressure is applied to the pressure receiving portion of the boom control valve 56A, then the boom cylinder 14 is stretched, and then the boom 10 is lifted.

When the operation lever 58 is tilted to the right side, the pilot valve (operating valve) 59C for the bucket dumping is operated, and then the pilot pressure of the pilot fluid to be outputted from the pilot valve 59C is set.

The pilot pressure is applied to the pressure receiving portion of the bucket control valve 56B, then the bucket cylinder 15 is stretched, and then the bucket 11 performs the dumping operation.

When the operating lever 58 is tilted to the left side, the pilot valve (operating valve) 59D for the bucket shoveling is operated, and then the pilot pressure of the pilot fluid to be outputted from the pilot valve 59D is set.

The pilot pressure is applied to the pressure receiving portion of the bucket control valve 56B, then the bucket cylinder 15 is shortened, and then the bucket 11 performs the shoveling operation.

The hydraulic system for the working machine includes a first control valve to control a flow rate of the operation fluid to be supplied from the first supply fluid tube 40 to the hydraulic actuator. In the embodiment, the first control valve is an auxiliary control valve 56C, and the hydraulic actuator is an auxiliary actuator. Hereinafter, description will be made assuming that the first control valve is the auxiliary control valve 56C.

The first supply fluid tube 40 has a first section 40*a* connecting the first hydraulic pump P1 and an input-side port of the auxiliary control valve 56C, and has at least two second sections 40*b* and 40*c* connected to an output-side port of the auxiliary control valve 56C.

One ends of the second sections 40*b* and 40*c* are connected to output ports 100 and 101 which are the output-side ports of the auxiliary control valve 56C. The other ends of the second sections 40*b* and 40*c* are connected to the connecting member 50.

In addition, the auxiliary control valve 56C is a switching valve having a spool, for example, is a direct-acting spool three-position switching valve of the pilot operation type.

The auxiliary control valve 56C is capable of being switched between first supply positions 62*a* and 62*b* for supplying the operation fluid to the auxiliary actuator and a stop position (a neutral position) for stopping supplying the operation fluid to the auxiliary actuator by the pilot pressures applied respectively to the pressure receiving portions 61*a* and 61*b*.

Pilot fluid tubes 86*a* and 86*b* are connected respectively to the pressure receiving portions 61*a* and 61*b* of the auxiliary control valve 56C. Proportional valves (a first proportional valve 60A and a second proportional valve 60B) are connected respectively to the pilot fluid tubes 86*a* and 86*b*. The proportional valves (the first proportional valve 60A and the second proportional valve 60B) are electromagnetic valves whose opening aperture can be changed by the magnetization.

The fluid tube 43 is connected to the first proportional valve 60A and to the second proportional valve 60B. The pilot fluid is supplied from the third hydraulic pump P3 to the first proportional valve 60A and to the second proportional valve 60B.

When the opening apertures of the first proportional valve 60A and the second proportional valve 60B are changed, the pilot pressure applied to the pressure receiving portions 61*a* and 61*b* of the auxiliary control valve 56C is changed, whereby the spool of the auxiliary control valve 56C moves in an arbitrary direction.

For example, when the first proportional valve 60A is opened, the pilot fluid is applied to the pressure receiving portion 61*a* of the auxiliary control valve 56C through the pilot fluid tube 86*a*, and thus the pilot pressure applied to the pressure receiving portion 61*a* is determined based on the opening aperture of the first proportional valve 60A. When the pilot pressure applied to the pressure receiving portion 61*a* becomes equal to or higher than a predetermined value, the spool of the auxiliary control valve 56C moves from the stop position 62*c* to the first supply position 62*a* side.

When the second proportional valve 60B is opened, the pilot fluid is applied to the pressure receiving portion 61*b* of the auxiliary control valve 56C through the pilot fluid tube

86*b*, and thus the pilot pressure applied to the pressure receiving portion 61*b* is determined based on the opening aperture of the second proportional valve 60B. When the pilot pressure applied to the pressure receiving portion 61*b* becomes equal to or greater than a predetermined value, the spool of the auxiliary control valve 56C moves from the stop position 62*c* to the first supply position 62*b* side.

Magnetization of the proportional valves 60 (the first proportional valve 60A and the second proportional valve 60B) is controlled by the control device 90. The control device 90 is constituted of a CPU or the like. An operation member 93 is connected to the control device 90. An operation amount (for example, a slide amount, a swing amount, and the like) of the operation member 93 is inputted to the control device 90.

The operation member 93 is constituted of, for example, a seesaw type switch that is swingable, a slide type switch that is slidable, or a push type switch that can be pressed. When the operation member 93 is operated in one direction, the operation amount of the operation member 93 in one direction (a first operation amount) is input to the control device 90, and the control device 90 changes the opening aperture of the first proportional valve 60A in accordance with the first operation amount.

Note that when the first operation amount is the maximum, the opening aperture of the first proportional valve 60A is the maximum, and when the first operation amount is the minimum, the opening aperture of the first proportional valve 60A is the minimum. That is, the first operation amount is in a substantially proportional relationship with the opening aperture of the first proportional valve 60A.

In addition, when the operation member 93 is operated in the other direction, the operation amount of the operation member 93 in the other direction (a second operation amount) is inputted to the control device 90, and the control device 90 changes the opening aperture of the second proportional valve 60B in accordance with the second operation amount.

In addition, when the second operation amount is the maximum, the opening aperture of the second proportional valve 60B is the maximum, and when the second operation amount is the minimum, the opening aperture of the second proportional valve 60B is the minimum. That is, the second operation amount is in a substantially proportional relationship with the opening aperture of the second proportional valve 60B.

As described above, according to the hydraulic system for the working machine, when the proportional valves 60 (the first proportional valve 60A and the second proportional valve 60B) are operated to move the spool of the auxiliary control valve 56C, the flow rate of the operation fluid to be supplied to the auxiliary actuator can be changed.

When the auxiliary control valve 56C is at the stop position (the neutral position) 62*c*, the operation fluid that has flowed through the auxiliary control valve 56C flows through the first system discharge fluid tube 110 and then is discharged to a discharge portion such as the operation fluid tank 22 or the like.

In particular, the first system discharge fluid tube 110 (which may be referred to simply as "the first discharge fluid tube 110" herein) is a fluid tube having one end connected to the discharge port 102 of the auxiliary control valve 56C and having the other end reaching the discharge portion such as the operation fluid tank 22 or the like. A bypass fluid tube 54 is connected to the first system discharge fluid tube 110 in the middle portion. In addition, a pressure increasing portion 130 is connected to the first system discharge fluid tube 110 at the middle portion separately from the bypass fluid tube 54.

The bypass fluid tube 54 is a fluid tube that connects the upstream side of the boom control valve 56A and the downstream side of the auxiliary control valve 56C. In the boom control valve 56A, the bucket control valve 56B, and the auxiliary control valve 56C, the operation fluid discharged from the hydraulic actuator (the boom cylinder 14, the bucket cylinder 15, and the auxiliary hydraulic actuator) is discharged to the first system discharge fluid tube 110.

In addition, a main relief valve 51 is connected to the bypass fluid tube 54. A fluid tube 53 having a relief valve 52 is connected to the bypass fluid tube 54 and to the downstream side of the pressure increasing portion 130 of the first system discharge fluid tube 110. The relief valve 52 operates as the pressure increasing portion for increasing the pressure of the operation fluid, similar to the pressure increasing portion 130 of the first system discharge fluid tube 110.

The pressure increasing portion 130 is an oil cooler for cooling the operation fluid, a relief valve, a throttle portion (a throttle valve), a choke valve, or the like.

In this embodiment, the pressure increasing portion 130 is an oil cooler. The pressure increasing portion 130 is arranged on a section 110*a* between a connecting portion 97 connected to the bypass fluid tube 54 on the upstream side of the first system discharge fluid tube 110 and a connecting portion 98 connected to the fluid tube 53 on the downstream side of the first system discharge fluid tube 110.

Thus, the operation fluid discharged from the discharge port 102 of the auxiliary control valve 56C can be discharged to the operation fluid tank 22 or the like through the pressure increasing portion 130 of the first system discharge fluid tube 110.

The operation fluid discharged from the discharge port 102 of the auxiliary control valve 56C also can be discharged from the second system discharge fluid tube 112 (which may be referred to simply as "the second discharge fluid tube 112" herein) other than the first discharge fluid tube 110. The second discharge fluid tube 112 is a fluid tube that is connected to the first discharge fluid tube 110 and discharges the operation fluid separately from the first discharge fluid tube 110.

One end of the second system discharge fluid tube 112 is connected to a section 110*al* between the connecting portion 97 and the pressure increasing portion 130 in the section 110*a* of the first system discharge fluid tube 110. The other end of the second system discharge fluid tube 112 reaches the discharge portion such as the operation fluid tank 22. The second control valve 65 is arranged on the middle portion of the second system discharge fluid tube 112.

In the embodiment, the second control valve 65 is a valve for increasing the flow rate of operation fluid to be supplied to the first supply fluid tube 40. Hereinafter, the description will be made assuming that the second control valve 65 is the high flow valve 65.

The second discharge fluid tube 112 may be referred to also as a first bypass fluid tube 112*a*.

The first bypass fluid tube 112*a* or the second discharge fluid tube 112 is a fluid tube that is connected to the section 110*a* between the auxiliary control valve 56C and the pressure increasing portion 130 in the system discharge fluid tube 110, and the first bypass fluid tube 112*a* or the second discharge fluid tube 112 reaches the high flow valve 65. The second bypass fluid tube 114 (which may be referred to as "the third discharge fluid tube 114") is a fluid tube that is connected to the high flow valve 65 separately from the first bypass fluid tube 112*a* or the second discharge fluid tube 112, through which the operation fluid in the first bypass fluid tube 112*a* can flow.

In particular, one end of the first bypass fluid tube 112*a* is connected by a connecting portion 99, and the other end is connected to the input port 81 of the high flow valve 65. The second bypass fluid tube 112*b* is connected to the output port 82 of the high flow valve 65.

The high flow valve 65 is arranged on the middle portion of the second supply fluid tube 41 that connects the second hydraulic pump P2 and the first supply fluid tube 40. The high flow valve 65 is a valve capable of setting the flow rate of the operation fluid flowing in the second supply fluid tube 41. Note that the end portion of the second supply fluid tube 41 is connected to the second section 40*b* of the first supply fluid tube 40.

In addition, in the second supply fluid tube 41, a check valve 47 is provided in the section between the high flow valve 65 and a coupling portion (a coupling portion between the first supply fluid tube 40 and the second supply fluid tube 41), the check valve 47 being configured to allow the operation fluid to flow toward the connecting portion 44 and prevent the operation fluid from flowing from the coupling portion 44 toward the high flow valve 65.

The high flow valve 65 is a three-position switching valve that operates with the pilot pressure, and can be switched between a supply position 65*a*, a first stop position 65*b*, and a second stop position 65*c* by the pilot pressure.

When the high flow valve 65 is at the supply position 65*a*, the input port 83 of the high flow valve 65 and the output port 84 communicate with each other, and the input port 81 and the output port 82 do not communicate with each other. That is, when the high flow valve 65 is at the supply position 65*a*, the middle portion of the second supply fluid tube 41 is opened, and the second system discharge fluid tube 112 is closed off.

As the result, the operation fluid in the second supply fluid tube 41 flows through the input port 83 and the output port 84, and is supplied to the second section 40*b* of the first supply fluid tube 40.

When the high flow valve 65 is in the first stop position 65*b*, the input port 83 of the high flow valve 65 and the output port 84 do not communicate with each other, and the input port 81 and the output port 82 do not communicate with each other.

That is, when the high flow valve 65 is in the first stop position 65*b*, fluid communication between the second supply fluid tube 41 and the second discharge fluid tube 112 is blocked. In the case of the first stop position 65*b*, fluid communication between the input port 83 of the high flow valve 65 and the output port 82 of the high flow valve 65 is allowed.

That is, in the first stop position 65*b*, the operation fluid in the second supply fluid tube 41 flows through the input port 83 and the output port 82, and is discharged from the second bypass fluid tube 112*b* to the operation fluid tank 22. Thus, the operation fluid is not supplied to the first supply fluid tube 40.

On the other hand, in the case of the first stop position 65*b*, the operation fluid discharged from the discharge port 102 flows through the pressure increasing portion 130 of the first system discharge fluid tube 110 to the operation fluid tank 22 or the like without flowing through the second discharge fluid tube 112.

When the high flow valve 65 is in the second stop position 65*c*, the input port 83 of the high flow valve 65 and the output port 84 do not communicate with each other, and the input port 81 and the output port 82 communicate with each other. Even in the case of the second stop position 65*c*, the input port 83 of the high flow valve 65 and the output port 82 communicate with each other.

That is, when the high flow valve 65 is in the second stop position 65*c*, the middle portion of the second supply fluid tube 41 is blocked, and the middle portion of the second system discharge fluid tube 112 is opened. In other words, the operation fluid in the second supply fluid tube 41 flows through the input port 83 and the output port 82, and is discharged from the second bypass fluid tube 112*b* to the operation fluid tank 22, so that the operation fluid is not supplied to the first supply fluid tube 40.

On the other hand, the operation fluid discharged from the discharge port 102 flows through the second discharge fluid tube 112, the input port 81, and the output port 82 of the high flow valve 65, and then is discharged through the third discharge fluid tube 114.

The high flow valve 65 is switched by the high flow switching valves 66A and 66B. The high flow switching valves 66A and 66B are respectively connected to the pressure receiving portions 65*d* and 65*e* of the high flow valve 65 through the fluid tubes 88 and 89. The high flow switching valves 66A and 66B can be switched to, for example, a first position 67 and to a second position 68.

When the high flow switching valve 66A is in the first position 67, the pilot pressure is not applied to the pressure receiving portion 65*d* of the high flow valve 65, and then the high flow valve 65 is set to the first stop position 65*b*. When the high flow switching valve 66A is in the second position 68, the pilot pressure is applied to the pressure receiving portion 65*d* of the high flow valve 65, and then the high flow valve 65 is set to the supply position 65*a*.

When the high flow switching valve 66B is in the first position 67, the pilot pressure is not applied to the pressure receiving portion 65*e* of the high flow valve 65, and then the high flow valve 65 is set to the first stop position 65*b*. When the high flow switching valve 66B is in the second position 68, the pilot pressure is applied to the pressure receiving portion 65*e* of the high flow valve 65, and then the high flow valve 65 is set to the second stop position 65*c*.

The controller 90 switches the high flow switching valves 66A and 66B between the first position 67 and the second position 68. The control device 90 is connected to operation members 94 and 95 such as switches configured to be turned ON/OFF. The operation members 94 and 95 are constituted of, for example, a seesaw type switch that is swingable, a push type switch that can be pressed, or the like.

When the operation member 94 is turned OFF and further the operation member 95 is turned OFF, the control device 90 demagnetizes the solenoids of the high flow switching valves 66A and 66B.

As described above, when the solenoids of the high flow switching valves 66A and 66B are demagnetized, the high flow switching valves 66A and 66B are in the first position 67, so that the high flow valve 65 is held at the first stop position 65*b*.

When the operation member 94 is turned ON, the control device 90 continuously magnetizes the solenoid of the high flow switching valve 66A and demagnetizes the solenoid of the high flow switching valve 66B regardless of whether the operation member 95 is turned ON or OFF.

In this manner, when the solenoid of the high flow switching valve 66A is magnetized and the solenoid of the high flow switching valve 66B is demagnetized, the high flow switching valve 66A is in the second position 68, and the high flow switching valve 66B is in the first position 67. Thus, the high flow valve 65 is held at the supply position 65*a*.

When the operation member 94 is turned OFF and further the operation member 95 is turned ON, the control device 90 demagnetizes the solenoid of the high flow switching valve 66A and magnetizes the solenoid of the high flow switching valve 66B.

In this manner, when the solenoid of the high flow switching valve 66A is demagnetized and further the solenoid of the high flow switching valve 66B is magnetized, the high flow switching valve 66A is in the first position 67, and the high flow switching valve 66B is in the second position 68. Thus, the high flow valve 65 is held at the second stop position 65*c*.

As described above, when the high flow valve 65 is set to the supply position 65*a*, the operation fluid outputted from the second hydraulic pump P2 can be added to the first supply fluid tube 40 through the second supply fluid tube 41.

In addition, when the high flow valve 65 is set to the first stop position 65*b*, the operation fluid outputted from the second hydraulic pump P2 is not added to the first supply fluid tube 40, while the operation fluid outputted from the auxiliary control valve 56C can be discharged to the operation fluid tank 22 through the pressure increasing portion 130.

Further, when the high flow valve 65 is set to the second stop position 65*c*, the operation fluid outputted from the second hydraulic pump P2 is not added to the first supply fluid tube 40, while the operation fluid outputted from the auxiliary control valve 56C is suppressed from flowing toward the pressure increasing portion 130 and can be discharged to the operation fluid tank 22 through the second system discharge fluid tube 112.

Figure 2:
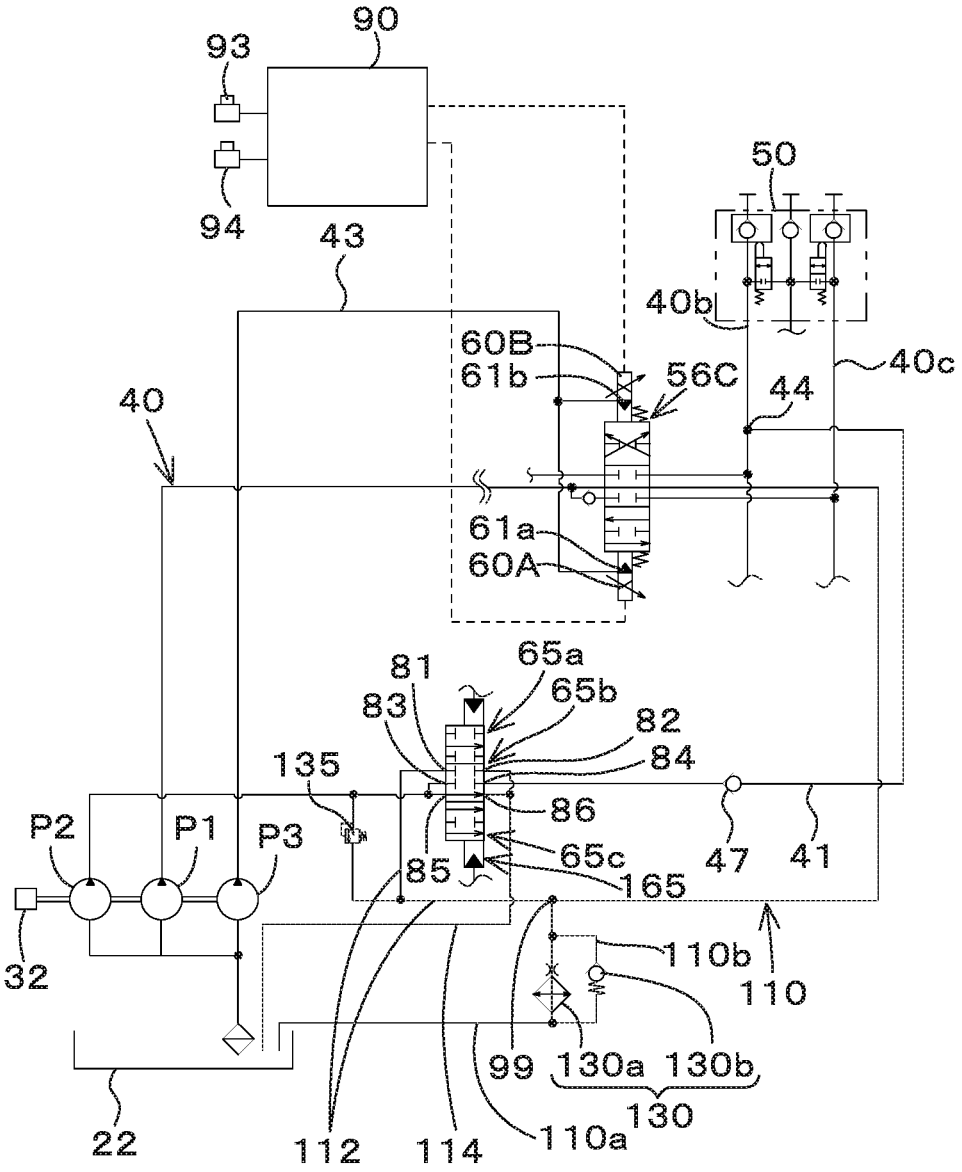
FIG. 2 is a modified example of the hydraulic system for the working machine according to the embodiment.

FIG. 2 is a modified example of the auxiliary control valve (the first control valve) 56C, the high flow valve (the second control valve), and the pressure increasing portion 130. In addition, the configurations similar to those of the embodiment described above are given reference numerals, and thus explanation thereof will be omitted.

In the embodiment described above, the auxiliary control valve 56C has the pressure receiving portions 61*a* and 61*b* and the proportional valves (the first proportional valve 60A and the second proportional valve 60B) configured separately. However, the pressure receiving portions 61*a* and 61*b* of the auxiliary control valve 56C and the proportional valves (the first proportional valve 60A and the second proportional valve 60B) are integrally configured as shown in FIG. 2.

The pressure increasing portion 130 includes an oil cooler 130*a* and a check valve 130*b* provided in a fluid tube (a bypass fluid tube) 110*b*.

That is, in the modified example of FIG. 2, the first system discharge fluid tube 110 includes the bypass fluid tube 110*b*, and the bypass fluid tube 110*b* is provided with a check valve 130*b* arranged in parallel with the oil cooler 130*a* that is one of the pressure increasing portions 130. In addition, the first system discharge fluid tube 110 may be provided with the plurality of pressure increasing portions 130 irrespective of the parallel arrangement and the series arrangement.

As shown in FIG. 2, a relief valve 135 is arranged on the upstream side of the high flow valve 165. The fluid tube provided with the relief valve 135 communicates with the second system discharge fluid tube 112.

The high flow valve 165*g* is a valve configured to be switched between a supply position 65*a*, a first stop position 65*b*, and a second stop position 65*c*. When the high flow valve 165 is in the supply position 65*a*, the input port 83 and the output port 84 communicate with each other, and the input port 81 and the output port 82 do not communicate with each other.

As a result, when the high flow valve 165 is in the supply position 65*a*, the operation fluid outputted from the second hydraulic pump P2 flows through the second supply fluid tube 41 and then is supplied to the first supply fluid tube 40 or the auxiliary actuator.

When the high flow valve 165 is in the first stop position 65*b*, fluid communication between the input port 83 and the output port 84 is blocked, and fluid communication between the input port 81 and the output port 82 is also blocked, while fluid communication between the input port 85 and the output port 86 is allowed.

As the result, when the high flow valve 165 is in the first stop position 65*b*, the operation fluid outputted from the second hydraulic pump P2 is discharged from the second bypass fluid tube 112*b* to the operation fluid tank 22 or the like through the input port 85 and the output port 86.

In addition, the operation fluid discharged from the discharge port 102 of the auxiliary control valve 56C is discharged to the operation fluid tank 22 or the like through the first system discharge fluid tube 110, the connecting portion 99, and the pressure increasing portion 130.

When the high flow valve 165 is in the second stop position 65*c*, fluid communication between the input port 83 and the output port 84 is blocked, fluid communication between the input port 81 and the output port 82 is allowed, and fluid communication between the input port 85 and the output port 86 is also allowed.

As the result, when the high flow valve 165 is in the second stop position 65*c*, the operation fluid outputted from the second hydraulic pump P2 is discharged from the second bypass fluid tube 112*b* to the operation fluid tank 22 or the like through the input port 85 and the output port 86.

In addition, the operation fluid outputted from the discharge port 102 of the auxiliary control valve 56C is discharged to the operation fluid tank 22 or the like through the first system discharge fluid tube 110, the connecting portion 99, the first bypass fluid tube 112*a*, the input port 81, the output port 82, and the second bypass fluid tube 112*b*.

The hydraulic system for the working machine includes: the first hydraulic pump P1 constituted of a fixed displacement pump; the second hydraulic pump P2 constituted of a fixed displacement pump; the hydraulic actuator; the first supply fluid tube 40 connecting the first hydraulic pump P1 and the hydraulic actuator; the second supply fluid tube 41 connecting the second hydraulic pump P2 and the first supply fluid tube 40; the first system discharge fluid tube 110 to discharge the operation fluid that has flowed through the first supply fluid tube 40; the second system discharge fluid tube 112 to discharge the operation fluid separately from the first system discharge fluid tube 110, the second system discharge fluid tube 112 being connected to the first system discharge fluid tube 110; the pressure increasing portion 130 to rise a pressure of the operation fluid, the pressure increasing portion 130 being arranged in the first system discharge fluid tube 110; the first control valve (the auxiliary control valve 56C) to control the flow rate of the operation fluid of the first supply fluid tube 40, the first control valve being arranged in the first supply fluid tube 40; and the second control valve (the high flow valve 65) connected to the second supply fluid tube 41, the first system discharge fluid tube 110, and the second system discharge fluid tube 112, configured to be switched between: the supply position 65*a* allowing the operation fluid of the second supply fluid tube 41 to be supplied to the first supply fluid tube 40; the first stop position 65*b* stopping supplying the operation fluid of the second supply fluid tube 41 to the first supply fluid tube 40 and allowing the operation fluid of the first supply fluid tube 40 to be discharged to the first system discharge fluid tube 110; and the second stop position 65*c* stopping supplying the operation fluid of the second supply fluid tube 41 to the first supply fluid tube 40 and allowing the operation fluid of the first supply fluid tube 40 to be discharged to the second system discharge fluid tube 112.

According to that configuration, when the second control valve (the high flow valve 65) is set to the supply position 65*a*, the operation fluid outputted from the second hydraulic pump P2 can be supplied to the first supply fluid tube 40 through the second supply fluid tube 41. Thus, the operation fluid in the first supply fluid tube 40 can be increased.

In addition, when the second control valve (the high flow valve 65) is set to the first stop position 65*b*, the operation fluid can be discharged through the pressure increasing portion 130 of the first system discharge fluid tube 110, and thus the cavitation generated when the hydraulic actuator is activated can be suppressed.

In addition, when the second control valve (the high flow valve 65) is set to the second stop position 65*c*, the operation fluid can be discharged through the second system discharge fluid tube 112 without flowing through the pressure increasing portion 130 of the first system discharge fluid tube 110. Thus, the power loss can be suppressed.

The second control valve (the high flow valve 65) opens the second supply fluid tube 41 and closes off the second system discharge fluid tube 112 when the second control valve is in the supply position 65*a*. The second control valve (the high flow valve 65) closes off the supply fluid tube 41 and the second system discharge fluid tube 112 when the second control valve is in the first stop position 65*b*. And, the second control valve (the high flow valve 65) closes off the second supply fluid tube 41 and opens the second system discharge fluid tube 112 when the second control valve is in the second stop position 65*c*.

In this manner, under the state where the flow rate of operation fluid to be supplied to the first supply fluid tube 40 is increased by closing off the second system discharge fluid tube 112 in the supply position 65*a*, the operation fluid discharged from the first control valve (the auxiliary control valve 56C) can be easily facilitated to flow not toward the second system discharge fluid tube 112 but toward the first system discharge fluid tube 110.

In addition, when the second control fluid tube 112 is shut off even at the first stop position 65*b*, the operation fluid discharged from the first control valve (the auxiliary control valve 56C) can be easily facilitated to flow toward the first system discharge fluid tube 110 even under the state where the flow rate of operation fluid to be supplied to the first supply fluid tube 40 is not increased.

In addition, when the second system discharge fluid tube 112 is opened at the second stop position 65*c*, the operation fluid discharged from the first control valve (the auxiliary control valve 56C) can be easily facilitated to flow toward the second system discharge fluid tube 112 under the state where the flow rate of operation fluid to be supplied to the first supply fluid tube 40 is not increased.

The first system discharge fluid tube 110 is the fluid tube connected to the discharge port 102 of the first control valve (the auxiliary control valve 56C), the first system discharge fluid tube 110 having the middle portion in which the pressure increasing portion 130 is arranged. The second system discharge fluid tube 112 includes: the first bypass fluid tube 112*a* connected to the section between the first control valve (the auxiliary control valve 56C) and the pressure increasing portion 130 in the first system discharge fluid tube 110, the first bypass fluid tube 112*a* extending to the second control valve (the high flow valve 65); and the second bypass fluid tube 112*b* through which the operation fluid of the first bypass fluid tube 112*a* flows, the second bypass fluid tube 112*b* being connected to the second control valve (the high flow valve 65) separately from the first bypass fluid tube 112*a*.

According to that configuration, the operation fluid discharged from the first control valve (the auxiliary control valve 56C) can be smoothly discharged without resistance to the first bypass fluid tube 112*a*, the second control valve (the high flow valve 65), and the second bypass fluid tube 112*b*.

The hydraulic actuator is the auxiliary actuator attached to the tip end of the boom. The first control valve (the auxiliary control valve 56C) is a valve to control the operation fluid to be supplied from the first supply fluid tube 40 to the auxiliary actuator. The second control valve (the high flow valve 65) is a valve to allow the operation fluid of the second supply fluid tube 41 to be supplied to the auxiliary actuator. According to that configuration, in the case where the auxiliary actuator is not operated, the power loss can be reduced while suppressing the cavitation.

The pressure increasing portion 130 is the oil cooler. According to that configuration, both the cooling of the operation fluid and the pressure increasing of the operation fluid can be easily performed by the oil cooler.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a first hydraulic pump to output first operation fluid to a first supply fluid tube;

a second hydraulic pump to output second operation fluid to a second supply fluid tube;

a hydraulic actuator;

a first control valve configured to control the first operation fluid to be supplied to the hydraulic actuator, the first control valve having a discharge port;

a first discharge fluid tube extending from the discharge port through a connecting portion to a pressure increasing portion which build an increased pressure of the operation fluid upstream thereof;

a second discharge fluid tube branched from the first discharge fluid tube at the connecting portion;

a second control valve connected to the second hydraulic pump and the second discharge fluid tube and configured to control the second operation fluid to be supplied to the hydraulic actuator; and a third discharge fluid tube connected to the second control valve, wherein the second control valve is configured to switch among a supply position, a first stop position and a second stop position, and at the supply position, to supply the second operation fluid to the hydraulic actuator, and to block fluid communication between the second discharge fluid tube and the third discharge fluid tube, at the first stop position, not to supply the second operation fluid to the hydraulic actuator, and to block fluid communication between the second discharge fluid tube and the third discharge fluid tube, and at the second stop position, not to supply the second operation fluid to the hydraulic actuator, and to allow fluid communication between the second discharge fluid tube and the third discharge fluid tube.

2. The hydraulic system according to claim 1, further comprising:

a third hydraulic pump to output third first operation fluid to a third supply fluid tube;

a switching valve connected to the third hydraulic pump and a pressure receiving portion of the second control valve, to apply pressure on the pressure receiving portion, thereby to switch the second control valve among the supply position, the first stop position and the second stop position; and a control device to control the pressure applied on the pressure receiving portion.

3. The hydraulic system according to claim 2, wherein the control device is provided with a first operation switch and a second operation switch, the control device controls the second control valve to switch to the supply position when the first operation switch is ON, switch to the first stop position when the first operation switch is OFF and the second operation switch is OFF, and switch to the second stop position when the first operation switch is OFF and the second operation switch is ON.

4. The hydraulic system according to claim 1, further comprising a check valve to allow fluid communication from an upstream side to a downstream side of the pressure increasing portion, and to block fluid communication from the downstream side to the upstream side thereof.

5. The hydraulic system according to claim 1, wherein the pressure increasing portion has an oil cooler.

6. The hydraulic system according to claim 1, wherein the hydraulic actuator is an auxiliary actuator attached to a tip end of a boom.

7. The hydraulic system according to claim 1, wherein each of the first hydraulic pump and the second hydraulic pump is constituted of a fixed displacement pump.

* * * * *